US006378618B1

(12) United States Patent
Yang et al.

(10) Patent No.: US 6,378,618 B1
(45) Date of Patent: Apr. 30, 2002

(54) CONTROL SWITCH FOR A FIRE EXTINGUISHER

(76) Inventors: Chen-Hsin Yang; Wen-Hsiang Tsai, both of P.O. Box 90, Tainan City (TW)

( * ) Notice: Subject to any disclaimer, the term of this patent is extended or adjusted under 35 U.S.C. 154(b) by 0 days.

(21) Appl. No.: 09/954,173

(22) Filed: Sep. 18, 2001

(51) Int. Cl.[7] ..... A62C 35/58

(52) U.S. Cl. ..... 169/88; 169/75; 169/74; 169/89; 222/153.11

(58) Field of Search ..... 169/88, 89, 72, 169/74, 75, 76, 30, 51; 222/153.11, 153.14, 324; 251/95, 101, 107

(56) References Cited

U.S. PATENT DOCUMENTS 2,541,073 A * 2/1951 Kaufman ..... 169/88
2,736,919 A * 3/1956 Nurkiewicz ..... 169/88
3,643,691 A * 2/1972 Huthsing, Jr. ..... 169/31
4,684,037 A * 8/1987 Gnutti et al. ..... 169/71
5,816,331 A * 10/1998 Vivier ..... 169/75

* cited by examiner

*Primary Examiner*—William Doerrler
*Assistant Examiner*—Dinh Q. Nguyen

(57) ABSTRACT

A control switch for a fire extinguisher in the present invention has a spring placed between a handle and an operating lever and pivoted by a pivot axle; a change-over switch pivoted within a through hole formed in the operating lever, by which the change-over switch can be changed over in an ON position and become vertical so that a press-in valve stem can be pressed by a bottom of the change-over switch to open a valve seat to inject a fire-extinguishing agent for extinguishing fire when the operating lever is pressed downward; the change-over switch can be changed over in an OFF position and become slanted so that the press-in valve stem can not be pressed and actuated by the bottom of the change-over switch even if the operating lever is pressed downward, thereby achieving an effect of safety control to the fire extinguisher and being convenient in operation.

3 Claims, 5 Drawing Sheets

CONTROL SWITCH FOR A FIRE EXTINGUISHER

BACKGROUND OF THE INVENTION

1. Field of the Invention

This invention relates to a control switch for a fire extinguisher, particularly to one having a change-over switch capable of being changed over to be pressed or not to be pressed against a press-in valve stem so as to actually control the fire extinguisher, thereby securing the safety of the fire extinguisher in use and being convenient in operation.

2. Description of the Prior Art

A known conventional fire extinguisher 1, as shown in FIG. 1, includes a nozzle holder 10, a valve seat 11, a press-in valve rod 12, a handle 13, a pressure gauge 14, a nozzle 15, and an operating lever 17. The valve seat 11 is disposed at an upper portion of the nozzle holder 10 and has a press-in valve rod 12 protruded on the valve seat 11. The pressure gauge 14 and the nozzle 15 are respectively disposed at sidewalls of the nozzle holder 10. The handle 13 is firmly mounted on the nozzle holder 10 and is pivoted with the operating lever 17 by a pivot axle 16. The operating lever 17 has two holes 18 respectively disposed at its two opposite sidewalls and extended through by a lock pin 19 whose both ends are rested against two top edges 130 of two opposite sidewalls of the handle 13 to limit the operating lever 17 in a position impossible to be pressed downward to push a top of the press-in valve rod 12 to inject a fire-extinguishing agent out of the nozzle 15 so that the fire extinguisher 1 can achieve an effect of safety control. In using, after the lock pin 19 is drawn from the two holes 18, the operating lever 17 can be pressed downward to push the top of the press-in valve rod 12 to inject the fire-extinguishing agent out of the nozzle 15. However, when the fire extinguisher 1 is stopped using, the drawn-out lock pin 19 is often lost and is unable to be extended back to the two holes 18 to limit the operating lever 17 in the safe position, which is very dangerous because the operating lever 17 is very easy to be pressed downward to inject a fire-extinguishing agent out of the nozzle 15 in error.

SUMMARY OF THE INVENTION

The main purpose of the invention is to offer a control switch for a fire extinguisher capable of achieving a safety control of the fire extinguisher without need of a lock pin and convenient in operation.

A main feature of the invention is to provide a control switch for a fire extinguisher having a spring placed between a handle as well as an operating lever and pivoted by a pivot axle so that the spring has one end urged against an inner surface of the operating lever and the other end urged against an inner surface of the handle; a through hole formed in a top surface of the operating lever; a change-over switch pivoted by a pivot shaft and disposed within the through hole of the operating lever.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
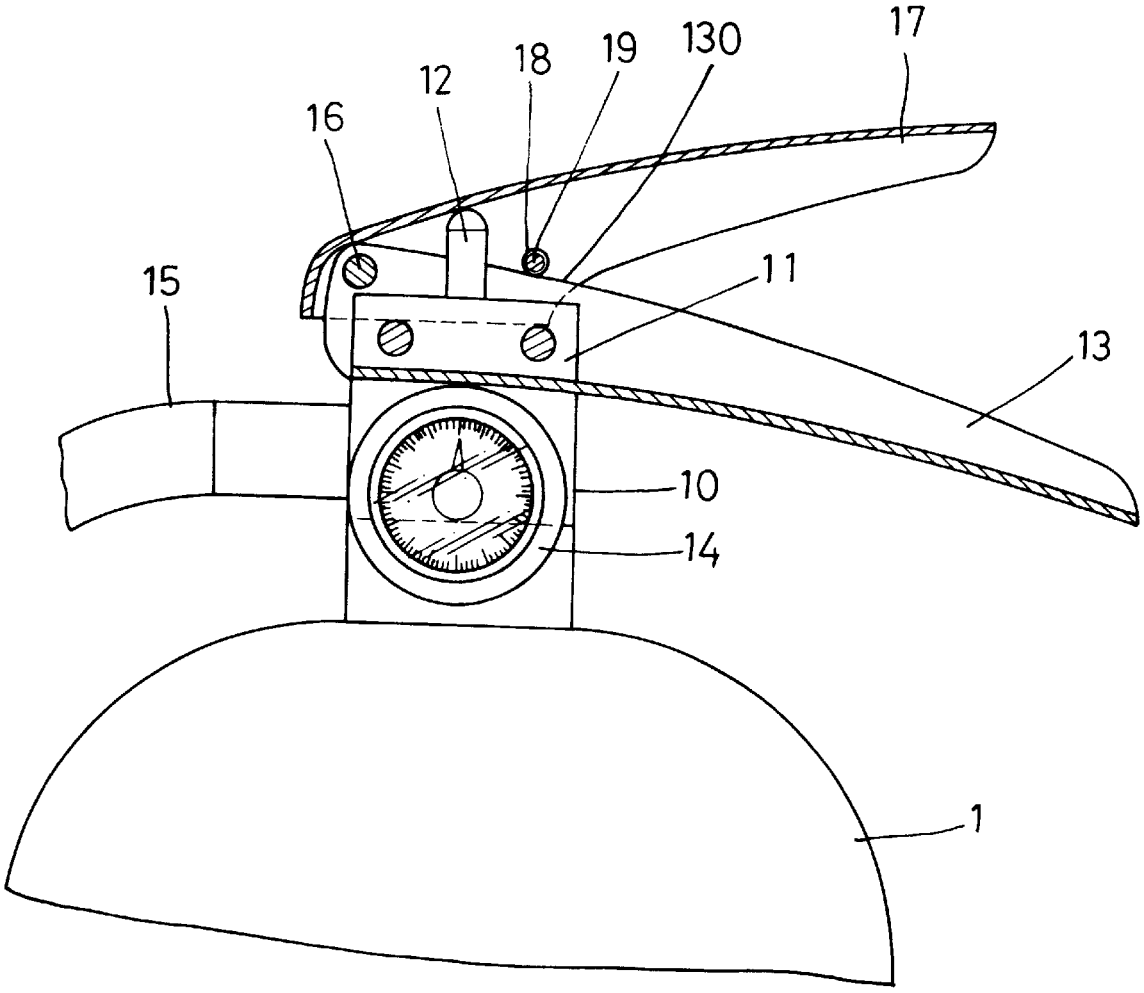
FIG.1 (PRIOR ART)
FIG. 1 is a schematic view of a known conventional fire extinguisher.
Figure 2:
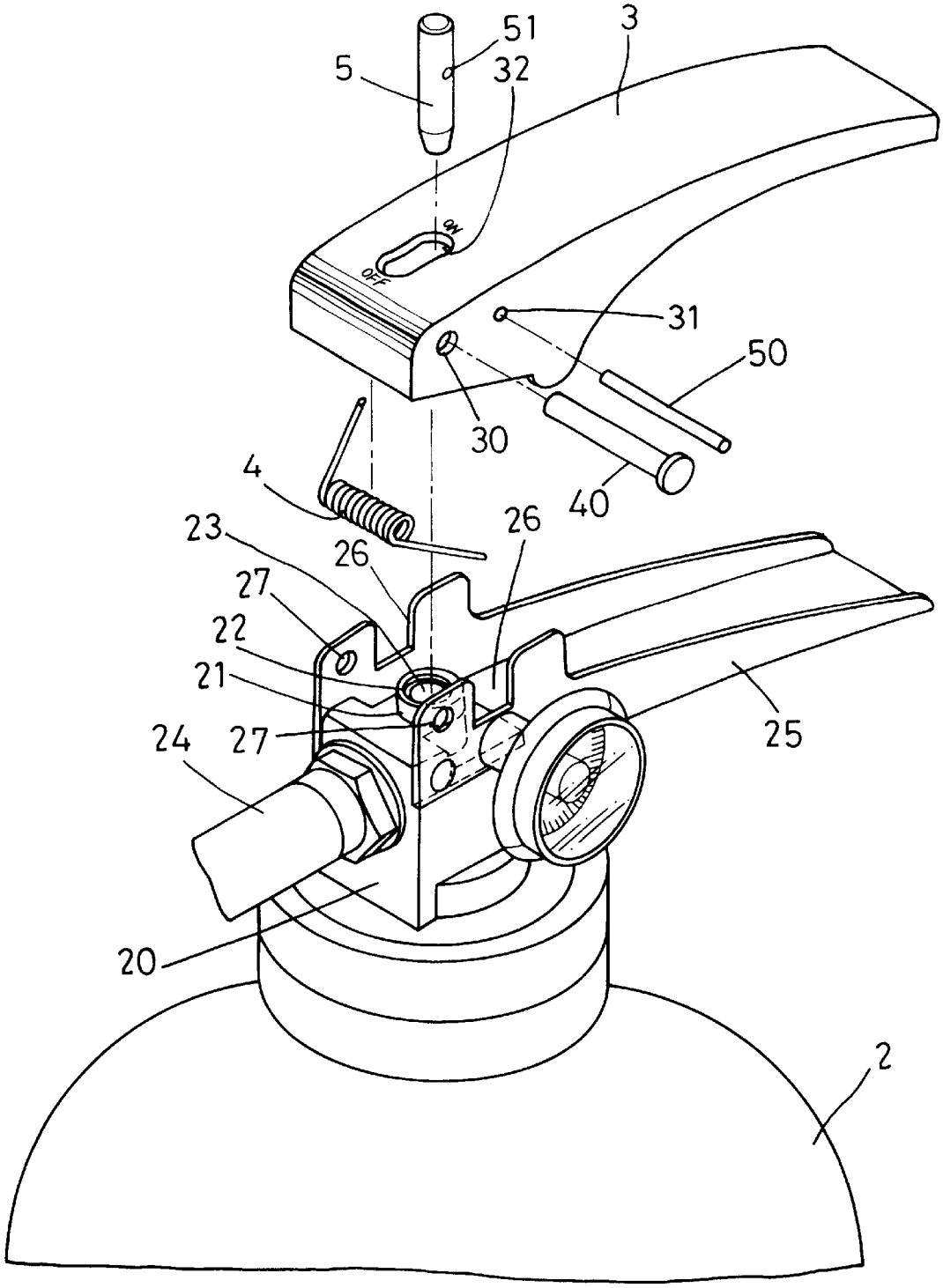
FIG. 2 is an exploded perspective view of a control switch for a fire extinguisher in the present invention.
Figure 3:
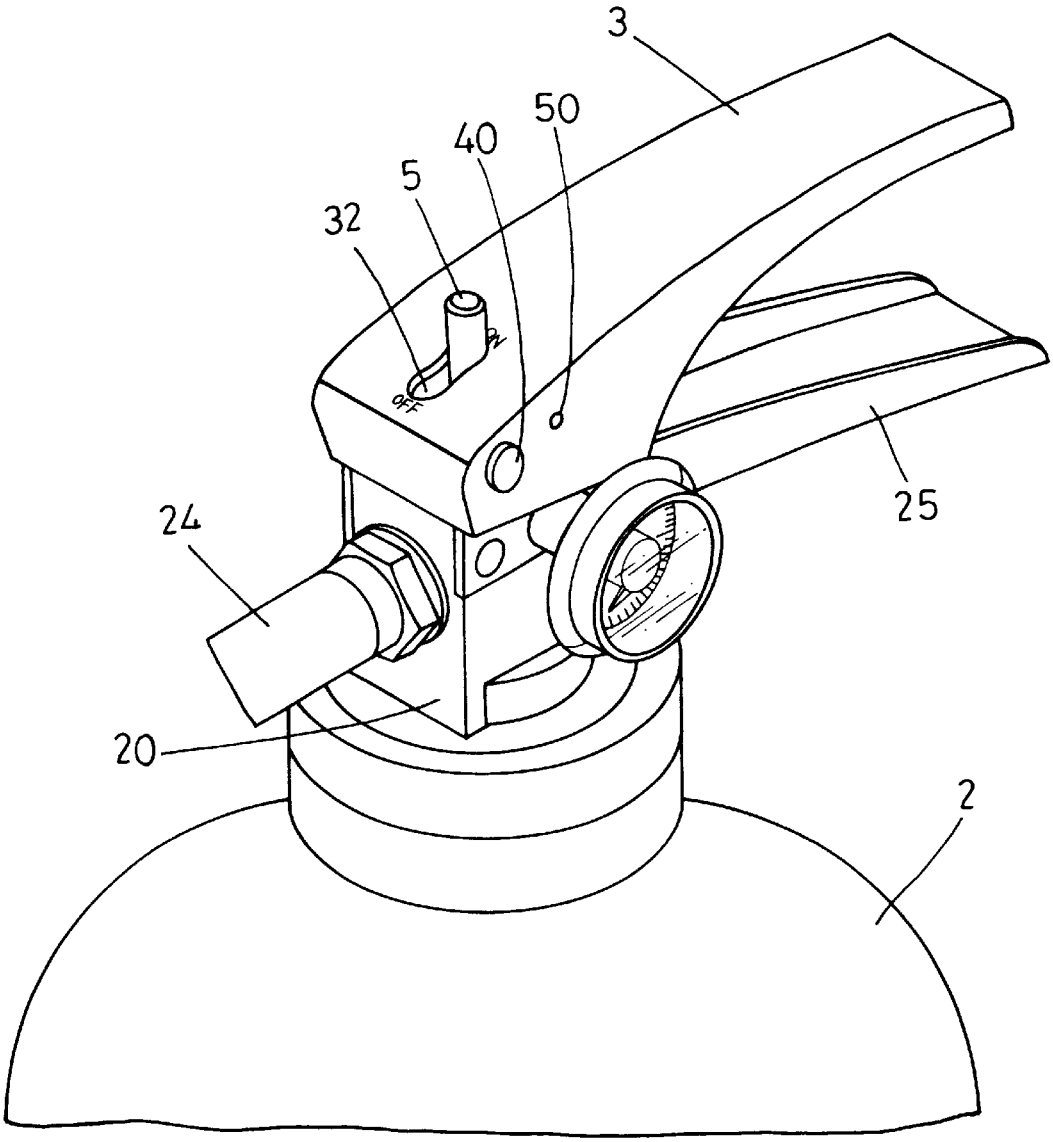
FIG. 3 is a perspective view of the control switch for a fire extinguisher in the present invention.
Figure 4:
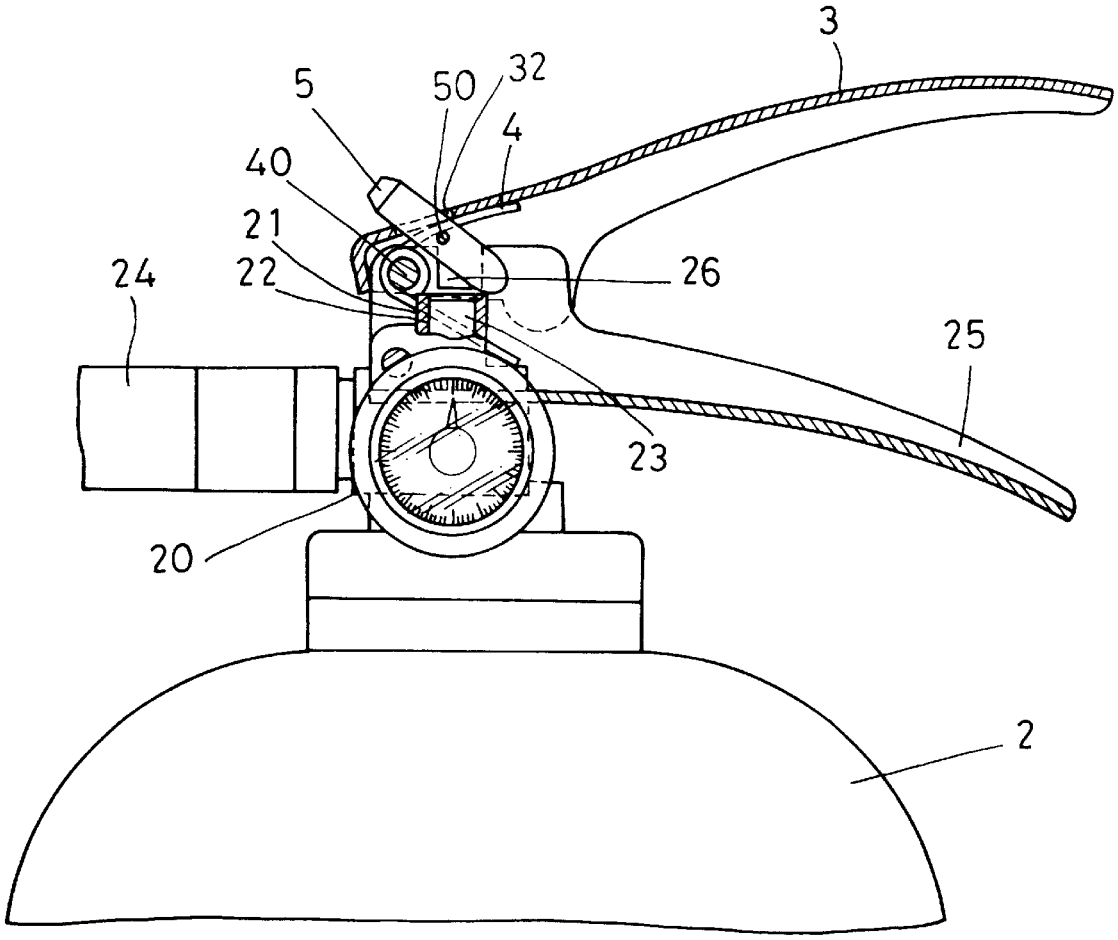
FIG. 4 is a cross-sectional view of the control switch for a fire extinguisher in the present invention, showing a change-over switch being in an OFF position; and, FIG. 5 is a schematic view of the control switch for a fire extinguisher in the present invention, showing the change-over switch being in an ON position and an operating lever being pressed downward.

A first preferred embodiment of a control switch for a fire extinguisher in the present invention, as shown in FIGS. 2, 3 and 4, includes a fire extinguisher 2, an operating lever 3, a spring 4 and a change-over switch 5.

The fire extinguisher 2 has a nozzle holder 20, a valve seat 21, a nozzle 24, and a handle 25. The valve seat 21 is protruded on the nozzle holder 20 and has a through hole 22 with a press-in valve stem 23 disposed therein. The nozzle 24 is connected to one side of the nozzle holder 20. The handle 25 firmly mounted on the nozzle holder 20 has two recesses 26 respectively disposed in two top edges of two opposite sidewalls of the handle 25 and two holes 27 respectively disposed in the two opposite sidewalls of the handle 25.

The operating lever 3 capable of being pivoted with the handle 25 has two holes 30, two pivot holes 31 as well as a through hole 32. The two holes 30 and the two pivot holes 31 are each respectively disposed in two opposite sidewalls of the operating lever 3. The through hole 32 shaped as an elongated ellipse with a waist portion in the middle is formed in a top surface of the operating lever 3.

The spring 4 placed between the handle 25 and the operating lever 3 is extended through and pivoted by a pivot axle 40.

The change-over switch 5 has a pivot hole 51 capable of being extended through and pivoted by a pivot shaft 50 within the through hole 32 of the operating lever 3.

In assembling, referring to FIGS. 2, 3 and 4, firstly extend the change-over switch 5 through the through hole 32 of the operating lever 3 and have the pivot hole 51 of the change-over switch 5 aligned with the two opposite pivot holes 31 of the operating lever 3 so that the pivot shaft 50 is capable of being extended through the pivot hole 51 of the change-over switch 5 as well as the two opposite pivot holes 31 of the operating lever 3 to have the change-over switch 5 pivoted within the through hole 32 of the operating lever 3 with one end of the change-over switch 5 protruded out of the through hole 32 of the operating lever 3.

Secondly, place the spring 4 inside the handle 25 and have the pivot hole of the spring 4 aligned with the two opposite holes 27 of the handle 25. And then, cover the operating lever 3 on the handle 25 and have the two opposite holes 30 of the operating lever 3 aligned with the two opposite holes 27 of the handle 25 in which the spring 4 has one end urged against an inner surface of the handle 25 and the other end urged against an inner surface of the operating lever 3. And further, use the pivot axle 40 to extend through the two opposite holes 30 of the operating lever 3, the pivot hole of the spring 4 and the two opposite holes 27 of the handle 25 to have the operating lever 3, the spring 4 and the handle 25 pivoted together, by which an assemblage of the whole structure of the control switch for a fire extinguisher in the present invention is completed.

When the fire extinguisher 2 is not in use, referring to FIG. 4, the change-over switch 5 is changed over to be in an OFF position of the through hole 32 of the operating lever 3 and becomes slanted, by which the change-over switch 5 is capable of being limited in the OFF position by the waist portion of the through hole 32 with a smaller diameter than that of the change-over switch 5 so that a bottom of the change-over switch 5 is unable to be inserted into the through hole 22 of the valve seat 21 to push the press-in valve stem 23 disposed in the through hole 22 of the valve seat 21. Therefore, in case that the operating lever 3 is pressed carelessly or during the carrying of the fire extinguisher 2, the press-in valve stem 23 may not be forcedly pressed downward by the bottom of the change-over switch 5 to open a valve body disposed in the valve seat 21 to inject a fire-extinguishing agent out of the nozzle 24, thereby achieving an effect of safety control to the fire extinguisher 2.

Figure 5:
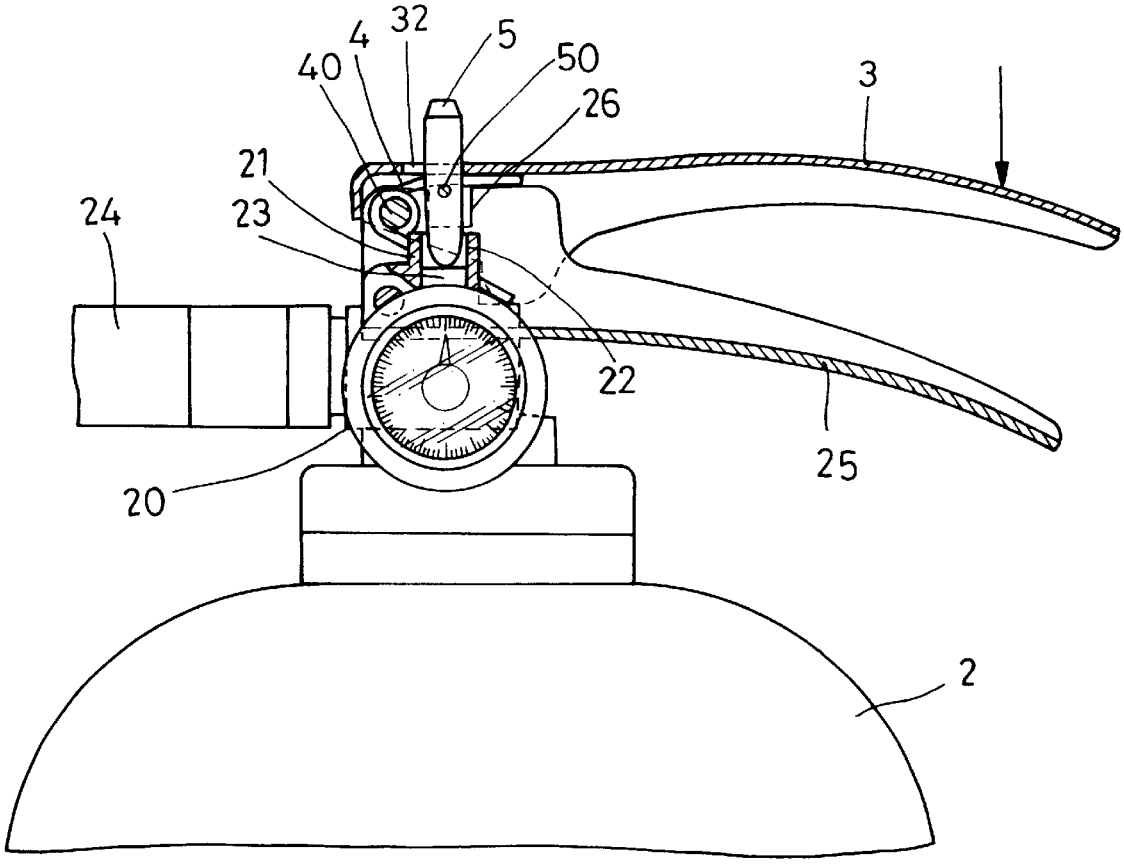

When the fire extinguisher 2 is in use, referring to FIG. 5, the change-over switch 5 is changed over to be in an ON position of the through hole 32 of the operating lever 3 and becomes vertical, by which the change-over switch 5 is capable of being limited in the ON position by the waist portion of the through hole 32 with a smaller diameter than that of the change-over switch 5 so that the bottom of the change-over switch 5 is allowed to be inserted into the through hole 22 of the valve seat 21 and pressed against the press-in valve stem 23. In an fire emergency, the operating lever 3 is pressed downward to have both ends of the pivot shaft 50 sunken into the two opposite recesses 26 of the handle 25 without being stopped by the two top edges of the two opposite sidewalls of the handle 25 so that the change-over switch 5 will be moved together with the pivot shaft 50 and carried downward to have its bottom forcedly pressed against the press-in valve stem 23 to open the valve body disposed in the valve seat 21 to inject the fire-extinguishing agent out of the nozzle 24 for extinguishing fire. After fire is extinguished or when the fire extinguisher 2 is stopped using, the change-over switch 5 is changed over to be in the OFF position of the through hole 32 of the operating lever 3 again, by which the fire-extinguishing agent can not be injected out of the nozzle 24 even if the operating lever 3 is pressed downward, thereby securing the safety control to the fire extinguisher 2. Moreover, the fire extinguisher 2 is very convenient in operation without need of a lock pin and without worry of losing the lock pin.

While the preferred embodiment of the invention has been described above, it will be recognized and understood that various modifications may be made therein and the appended claims are intended to cover all such modifications that may fall within the spirit and scope of the invention.

What is claimed is:

1. A control switch for a fire extinguisher comprising:

a fire extinguisher having a nozzle holder, a valve seat, a nozzle and a handle, said valve seat protruded on said nozzle holder and having a through hole with a press-in valve stem disposed therein, said nozzle connected to one side of said nozzle holder, said handle firmly mounted on said nozzle holder and having two holes respectively disposed in two opposite sidewalls of said handle;

an operating lever having two holes respectively disposed in two opposite sidewalls of said operating lever and capable of being pivoted with said handle by a pivot axle extended through said two opposite holes of said operating lever as well as said two opposite holes of said handle;

characterized by a spring placed between said handle as well as said operating lever and extended through and pivoted by said pivot axle so that said spring has one end urged against an inner surface of said operating lever and the other end urged against an inner surface of said handle; a through hole formed in a top surface of said operating lever; a change-over switch pivoted by a pivot shaft and disposed within said through hole of said operating lever; and, whereby said change-over switch is capable of being changed over to be in an ON position and becomes vertical so that said press-in valve stem of said valve seat can be pressed against by a bottom of said change-over switch to open said valve seat to inject a fire-extinguishing agent for extinguishing fire when said operating lever is pressed downward; said change-over switch is capable of being changed over to be in an OFF position and becomes slanted so that said press-in valve stem of said valve seat can not be pressed against and actuated by said bottom of said change-over switch even if said operating lever is pressed downward, thereby achieving an effect of safety control to said fire extinguisher and being convenient in operation.

2. The control switch for a fire extinguisher as claimed in claim 1, wherein two recesses are respectively disposed in two top edges of said two opposite sidewalls of said handle.

3. The control switch for a fire extinguisher as claimed in claim 1, wherein a pivot hole is disposed in said change-over switch and two pivot holes are respectively disposed in said two opposite sidewalls of said operating lever; whereby said pivot shaft is capable of being extended through said two pivot holes of said operating lever and said pivot hole of change-over switch so as to have said change-over switch pivoted within said through hole of said operating lever.

* * * * *